US006932244B2

(12) United States Patent
Meshberg

(10) Patent No.: US 6,932,244 B2
(45) Date of Patent: Aug. 23, 2005

(54) AEROSOL DISPENSING DEVICE

(75) Inventor: Philip Meshberg, Palm Beach, FL (US)

(73) Assignee: Dispensing Patents International, LLC, Boynton Beach, FL (US)

( * ) Notice: Subject to any disclaimer, the term of this patent is extended or adjusted under 35 U.S.C. 154(b) by 188 days.

(21) Appl. No.: 10/635,527

(22) Filed: Aug. 7, 2003

(65) Prior Publication Data

US 2004/0026454 A1 Feb. 12, 2004

Related U.S. Application Data

(63) Continuation-in-part of application No. 09/933,011, filed on Aug. 21, 2001, now Pat. No. 6,691,896.

(51) Int. Cl.[7] ..... B67B 5/00

(52) U.S. Cl. ..... 222/153.13; 222/402.11; 222/519; 222/548

(58) Field of Search ..... 222/153.11–153.14, 222/182, 321.1, 321.7, 402.1, 519, 402.11, 548

(56) References Cited

U.S. PATENT DOCUMENTS 3,401,843 A * 9/1968 Ahrens et al. ..... 222/182
3,484,023 A * 12/1969 Meshberg ..... 222/402.11
3,904,088 A 9/1975 Milbourne, Sr.
5,772,080 A * 6/1998 de Pous et al. ..... 222/321.7
6,247,613 B1 6/2001 Meshberg
6,695,171 B2 * 2/2004 Walters et al. ..... 222/153.13
2003/0106901 A1 6/2003 Meshberg

* cited by examiner

*Primary Examiner*—Michael Mar
(74) *Attorney, Agent, or Firm*—Kenyon & Kenyon

(57) ABSTRACT

An aerosol dispensing device includes a rotating actuator, an upstanding wall partially surrounding the actuator, and a sliding nozzle closure. The actuator may include a spray nozzle and a downwardly extending projection, in fluid communication with the spray nozzle, to sealingly engage an upwardly projecting stem of an aerosol valve. The upstanding wall may include an upper opening, a lower opening below the upper opening, and a spray opening. The sliding nozzle closure may include an upper projection, fitting into the upper opening and the spray nozzle, to seal the spray nozzle when the actuator is in a non-dispensing position, and, a lower member, fitting into the lower opening, to facilitate the sliding movement of the nozzle closure.

24 Claims, 10 Drawing Sheets

AEROSOL DISPENSING DEVICE

CLAIM FOR PRIORITY/CROSS REFERENCE TO RELATED APPLICATIONS

This non-provisional application is a continuation-in-part of U.S. patent application Ser. No. 09/933,011, filed on Aug. 21, 2001 now U.S. Pat. No. 6,691,896 (published on Feb. 27, 2003 as U.S. patent application Publication 2003/0038146 A1), which is incorporated by reference herein in its entirety.

BACKGROUND OF THE INVENTION

The present invention generally relates to aerosol dispensers, and, more particularly, to an aerosol dispensing device displaying anti-clog properties.

U.S. Pat. No. 5,593,064, the disclosure of which is hereby incorporated by reference in its entirety, discloses a promotional dispensing package which is easily shipped, filled and assembled is disclosed. The package includes a retaining opening into which a modular pump is snap-fit by inserting the modular pump through an open end of the package. The package also includes a upstanding wall, which provides a dispensing actuator locking and sealing mechanism, as well as a tamper-evident tab. The package and pump are assembled at a production site, and are thereafter shipped to a filling site with a bottom. The package is filled through the open bottom end, and then the bottom is sealingly affixed to the package. Accordingly, the device can be filled and finally assembled with a minimal number of steps, and is therefore particularly suited for quick-turnaround marketing.

Although the package includes a dispensing actuator locking and sealing mechanism, as well as a tamper-evident tab, it is not childproof. That is, it is relatively easy, by rotation, to unlock the actuator and dispense material. In some cases the package might be used, for example, for a breath freshener and spraying in the mouth expected. However, the package might also contain insect repellant, sun tan lotion, or another product which is toxic if ingested. Particularly in view of these multiple uses, a young child could pick up a dispenser containing a toxic material and ingest it.

Moreover, the actuator nozzles and spray openings of these dispensing actuators are prone to clogging, particularly when used with aerosol products, such as spray paint aerosol dispensers.

SUMMARY OF THE INVENTION

Embodiments of the present invention include a rotating actuator, an upstanding wall partially surrounding the actuator, and a sliding nozzle closure. The actuator may include a spray nozzle and a downwardly extending projection, in fluid communication with the spray nozzle, to sealingly engage an upwardly projecting stem of an aerosol valve. The upstanding wall may include an upper opening, a lower opening below the upper opening, and a spray opening. The sliding nozzle closure may include an upper projection, fitting into the upper opening and the spray nozzle, to seal the spray nozzle when the actuator is in a non-dispensing position, and a lower member, fitting into the lower opening, to facilitate the sliding movement of the nozzle closure.

DETAILED DESCRIPTION

Figure 1:
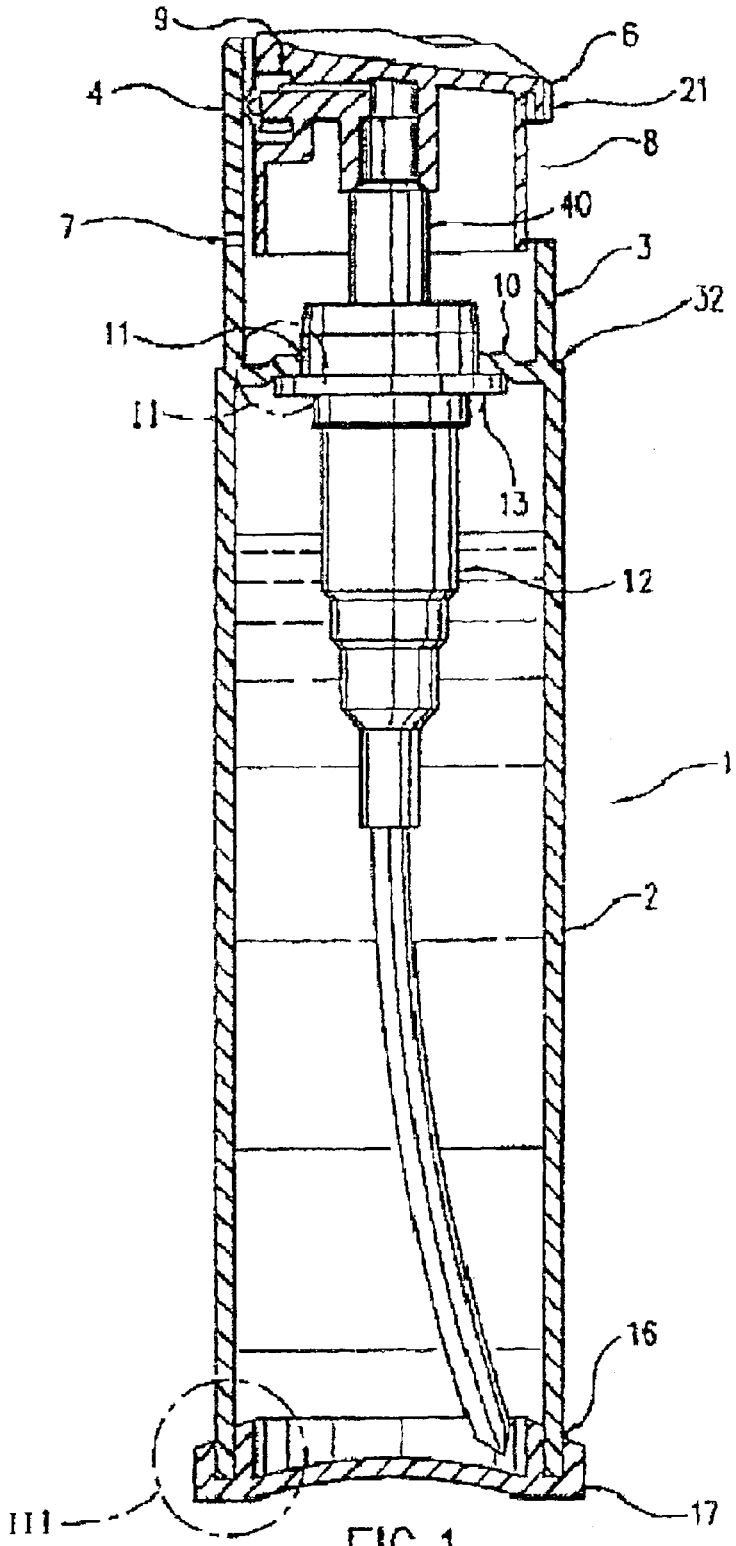
FIG. 1 is a cross-sectional view of a dispenser with which the present invention may be used.

An embodiment of a dispenser with which the present invention may be used is shown in cross-sectional view, in a sealed condition, in FIG. 1. The dispenser includes a package 1 which includes a container 2 and an upstanding wall 3 forming a sleeve. Upstanding wall 3 includes a tamper evident tab 4, connected to the upstanding wall 3 by a snap-away or tear-away joint 7. Joint 7 is originally molded to integrally connect tab 4 to upstanding wall 3; but is designed to be of sufficient thinness so that an end user can ultimately break the joint 7 so that the tab 4 can be removed from sleeve 3 to uncover nozzle 9 on actuator 6 when it is desired to first use the dispenser 1. Upstanding wall 3 can include opening 8 intended to facilitate movement of an actuator nozzle 9 within the upstanding wall 3. Although shown as being vertically oriented in FIG. 1, tab 4 could also be oriented in a horizontal direction, with the joint 7 being disposed vertically at one end of the tab 4.

Container 2 and upstanding wall 3 are separated by a retaining wall 10 which includes a retaining opening 11 used to secure a pump 12 in the package 1. Pump 12 can be of any conventional design. Pump 12 includes a retention flange 13 for limiting the amount of inward movement of the pump 12 into the container 1 and for providing a surface for an energy director 15 to adhere during a process of sonic or ultrasonic welding. Alternatively, pump could include a retention groove which retains the pump 12 in the package 1 via a snap-fit engagement with retaining wall 10. Pump 12 is inserted into retaining opening 11 through the lower end 16 of container 2 or from the upper end including the upstanding wall 3, which is initially open. Pump 12 has a projecting stem 40 on the end of which actuator 6 is mounted.

Figure 2:
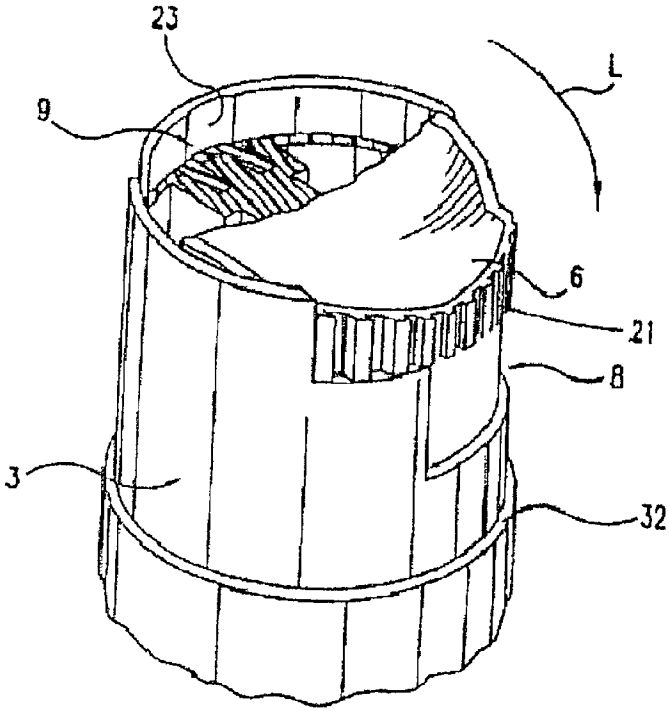
FIGS. 2–4 are perspective views of an actuator and locking mechanisms, wherein FIG. 4 includes a partial cross-sectional view.
Figure 4:
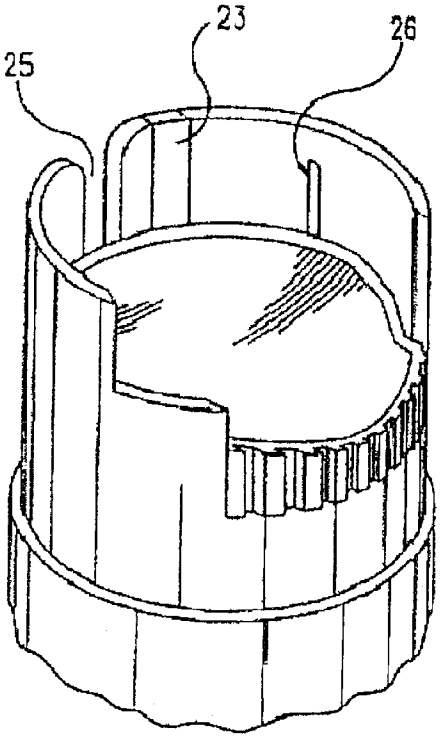
Figure 3:
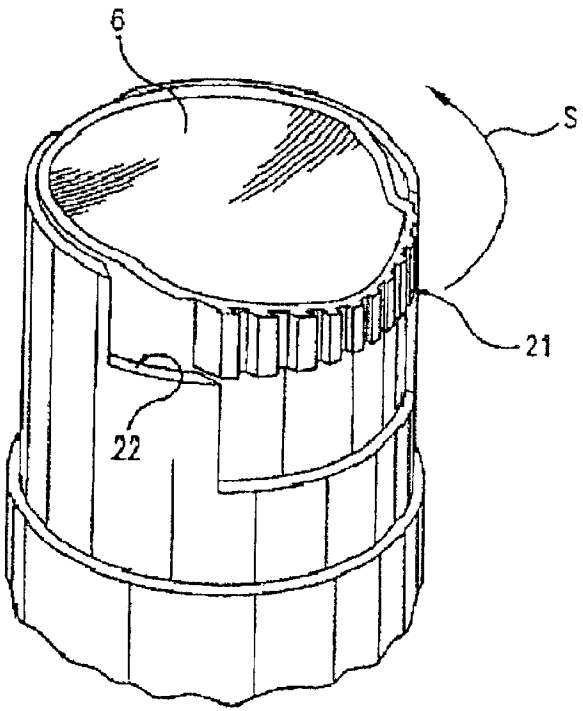

FIGS. 2–4 show the particular features of the actuator 6 of the dispenser, and the particular locking and retaining features of the upstanding wall 3. In FIG. 2, the forward of actuator 6 is shown in cross-sectional view, to show the manner in which the nozzle 9 is sealed in a non-dispensing position. Actuator 6 includes a projecting edge 21 which is used to rotate actuator 6 from a dispensing to a non-dispensing position, and which also acts to prevent downward movement of actuator 6 when actuator 6 is in a non-dispensing position. Upstanding wall 3 includes a limit stop 22 which prevents actuator 6 from moving downward—and thus dispensing material from pump 12—via engagement with limit stop 22 (See FIG. 2). The position of the actuator 6 shown in FIG. 2 is the position in which the actuator 6 is kept before the tab 4 is remove from upstanding wall 3. In this position, nozzle 9, which includes a slightly projecting tip, is snapped into a vertical groove 23. Groove 23 acts to retain nozzle 9 and actuator 6 in a non-dispensing position, and also seals the nozzle 9 against the incursion of air into the nozzle 9 orifice.

Rotating actuator 6 in the direction indicated by arrow S places the actuator 6 and nozzle 9 into a spraying or dispensing position. In the actuator as disclosed in U.S. Pat. No. 5,593,064, there was nothing to prevent this rotation. Thus, it could be done by a young child. In the dispensing position (shown in FIGS. 3 and 4) projecting edge 21 is in alignment with opening 8. In this position, nozzle 9 is aligned with opening 25 which is formed when tab 4 is removed. As seen by comparing FIGS. 3 and 4, projecting edge 21 travels within opening 8 upon downward actuation of actuator 6, allowing dispensing of material through nozzle 9 via pump 12. Rotating actuator 6 in the direction indicated by arrow L into a locking position, in which nozzle 9 is snapped into groove 23. Indication that nozzle 9 is properly in a non-dispensing position can be provided via a bead 26, which can contact with a bead on the outer circumferential surface of actuator 6, thereby providing an audible "snapping" sound when the beads slide over one another.

Figure 5:
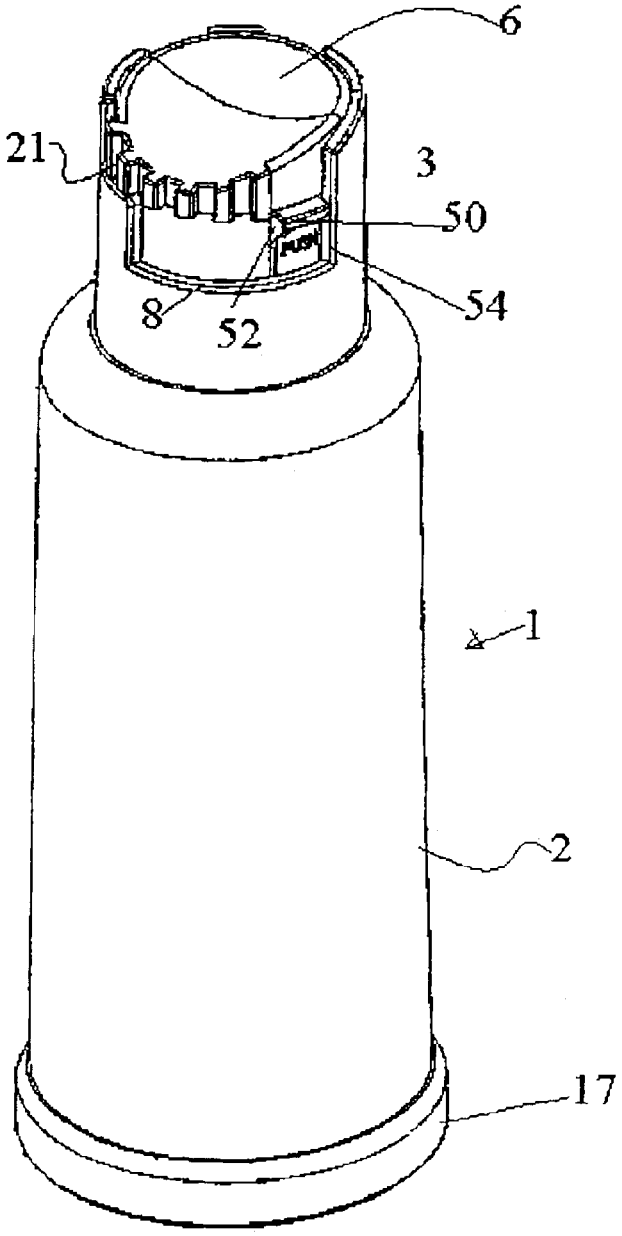
FIG. 5 is a rear perspective view of the dispenser with the safety tab of the present invention installed.

FIG. 5 is a rear perspective view of the package 1 of FIG. 1 in which the safety lock of the present invention is incorporated. Visible is the actuator 6 in sleeve 3. As noted above, the actuator must be rotated to align projecting edge 21 with opening 8. However, in accordance with the present invention, a safety tab 50 is formed in actuator 6 and has a projecting lip 52 which abuts a vertical wall 54 of opening 8 and prevents rotation. The tab 50 is hinged at its base and biased outwardly. To carry out rotation, one must push in on the tab 50 until the lip 52 clears the wall 54, while at the same time rotating the actuator. This is a two handed operation which is difficult for a small child to perform.

Figure 6:
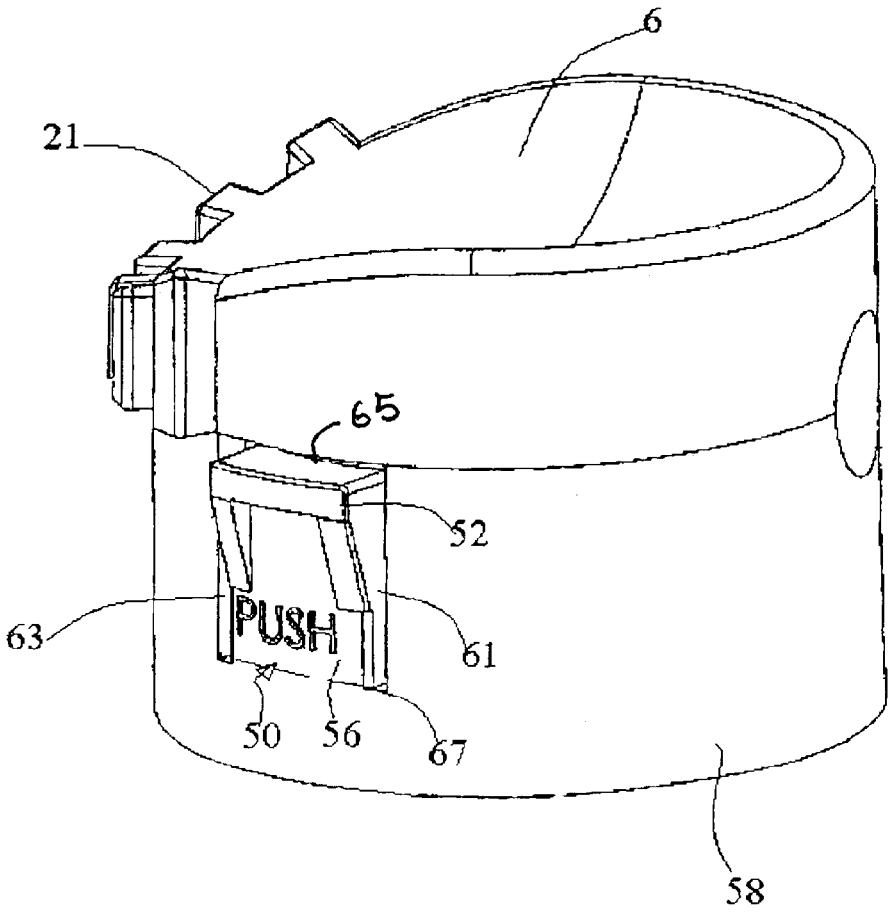
FIG. 6 is a perspective view of the actuator of the dispenser with the safety tab of the present invention.

FIG. 6 is a perspective view of actuator 6. In the illustrated embodiment, the tab 50 is molded in the wall 58 of the actuator 6. The base 56 of tab 50 is just a of wall 58. At the upper end of tab 50, the projecting lip 52 is formed. Vertical slits 61 and 63 and horizontal slit 65, extending through wall 58, separate tab 50 from the rest of the wall 58. Thus, by pushing in on the projecting lip 52, it can be forced to rotate about its base 67 which acts as a hinge. The fact that is an integral part of wall 58 insures that the projecting lip is biased outwardly. Although this is a simple way to form the biased hinged tab, other arrangement with different types of hinges and different forms of biasing may equally well be used.

The method of using the illustrated embodiment is as follows. The container 2 is molded as an integral unit with upstanding wall 3 and retaining wall 10. Container 2 is inverted, and may be inserted into a holding or restraining mechanism which interacts with shoulder 32 to restrain container 2 in an inverted position. Next, pump 12 is inserted into either the open end of lower end 16 or upper end including upstanding wall 3, so that the upper of pump 12 fits through retaining opening 11 until flange 13 abuts retaining wall 10. Actuator 6, with tab 50 formed therein, can then be inserted onto the outlet stem 40 of pump 12.

The container 2 thus assembled is shipped together with bottom 17 in an unassembled condition to a filling and assembly location where it may be filled and labeled and shipped to an end user.

Upon receiving package 1, the customer breaks off tab 4, and then when dispensing is desired, rotates actuator 6 to the position shown in FIG. 5. To do this, as noted above, it is necessary to first press in on tab 50 until it clears wall 54 of opening 8, while at the same carrying out a rotation. Downward actuation of actuator 6 dispenses liquid product from package 1, through nozzle 9. Upon completion of actuation, the actuator 6 is rotated back to the position shown in FIG. 5 and tab 50 snaps back in the position where the actuator can not be rotated without pushing it in again.

Figure 7:
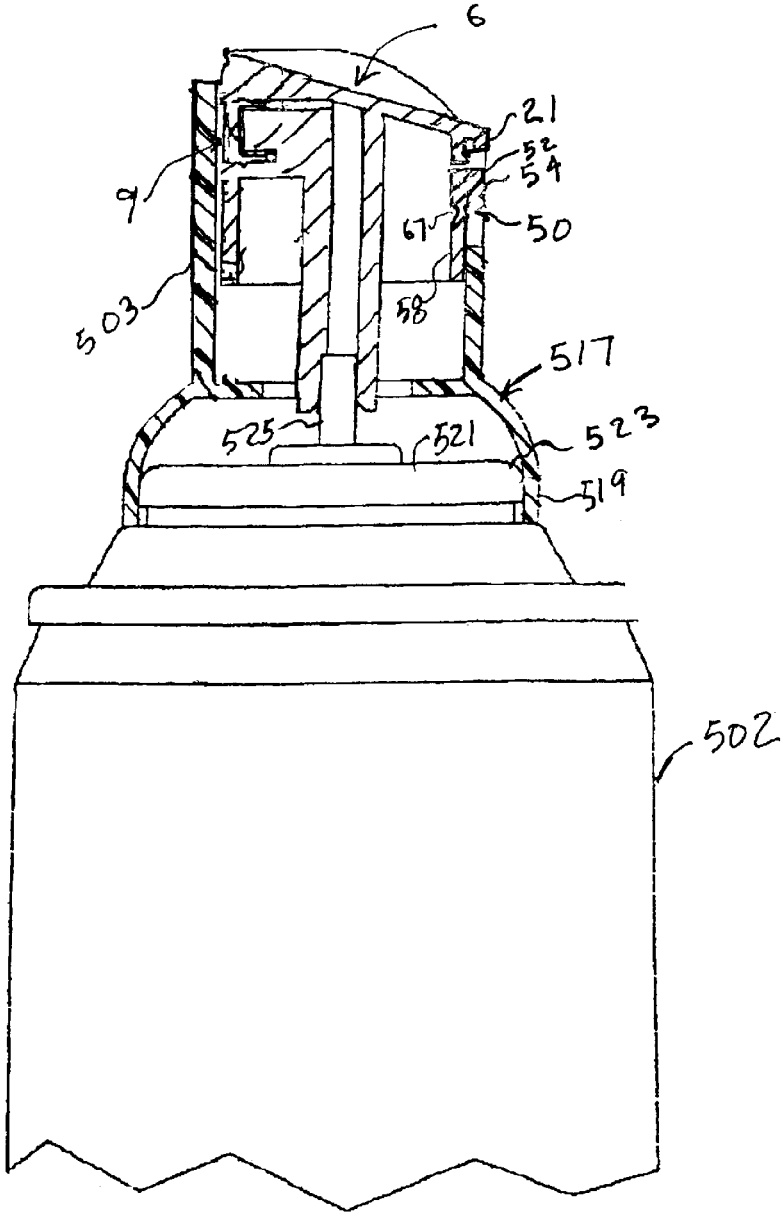
FIG. 7 is a cross-sectional view of an embodiment of the safety device of the present invention mounted on an; aerosol dispenser.

The embodiment of FIG. 1 is directed to a pump. However, the actuators with spray nozzles described herein may also be used with aerosol valves. A specific example of an embodiment of the present invention used with an aerosol valve is shown in FIG. 7, which shows an aerosol container 502 with a mounting cap 517 which includes an embodiment of the nozzle closure of the present invention of the general nature shown in FIGS. 2–6. The mounting cap 517 shown in FIG. 7 includes a cylindrical skirt 519 which engages a beaded rim 523 of a mounting cup 521, at the top of the aerosol container 502, with a press fit, attaching mounting cap 517, and with its upstanding wall 503, to container 502. The mounting cap can also or alternatively be designed with a bead on its end, which will allow it to snap over the beaded rim 523. Wall 503 is constructed in a manner similar to wall or sleeve 3 of the previously explained embodiments. Container 502 includes, at its upper end, a beaded rim 523 extending around its entire circumference. In conventional fashion, this is part of mounting cup 521. Mounting cup 521 contains an aerosol valve and has as its purpose mounting the aerosol valve to the top of container 502. A stem 525 for actuating the aerosol valve projects from the aerosol valve in conventional fashion. Downwardly extending projection 599 of actuator 6 is pressed onto the projecting stem to permit actuating the valve and dispensing material through nozzle 9.

The construction and operation of safety lock of the present invention is as explained above. The cross-sectional view of FIG. 7 shows tab 50 with projecting lip 52 abutting against wall 54. Base 67 of the tab 50 is a thinner section of the wall to act as a hinge. In the position shown, the dispensing outlet or nozzle 9 of the actuator 6 is behind wall 3 and dispensing is not possible. It is necessary to rotate actuator 6 to a position where nozzle 9 is aligned with an opening (not shown) such as the opening 25 of FIG. 4. In order to do this, the tab 50 must be pushed in, clear of the wall 54, and the actuator rotated at the same time, as described above, a difficult task for a small child.

In the embodiment of FIG. 1, the upstanding wall 3 is integral with the container. It will be recognized that just as the arrangement of the present invention can be added to a conventional aerosol dispenser, as illustrated in FIG. 7, it can also be added to an existing pump dispenser but providing a mounting cap which engages the body of the pump dispenser. These and other modifications can be made without departing from the spirit of the invention.

Furthermore, embodiments of the present invention has been described in the context of a liquid dispensing package. However, it is equally applicable to other types of packages, where a safety feature is need. Examples, include medicine bottles, containers for household chemical etc. All that is required is a sleeve attached to the container and within which a part (the actuator in the illustrated embodiment) is rotated place the container in a position where dispensing can take place. In the illustrated embodiment the actuator is pressed to spray a material. If the container contained liquid or powder to be poured, the rotation would result in removal or partial removal of a cap. The sleeve has a opening with a wall against which an outwardly biased hinged tab on the first part abuts and prevents rotation, unless the tab is pushed in to clear the wall, while at the same time rotating the first part into an open or dispensing position. These and other modifications can be made without departing from the spirit of the invention which is intended to be limited solely by the appended claims.

Figure 8B:
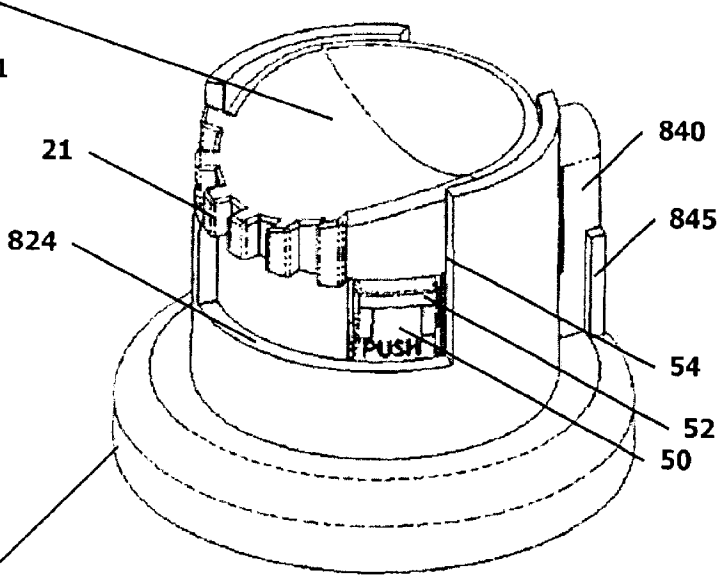
FIGS. 8A and 8B depict anterior and posterior perspective views, respectively, of an embodiment of the aerosol dispensing device of the present invention.
Figure 8A:
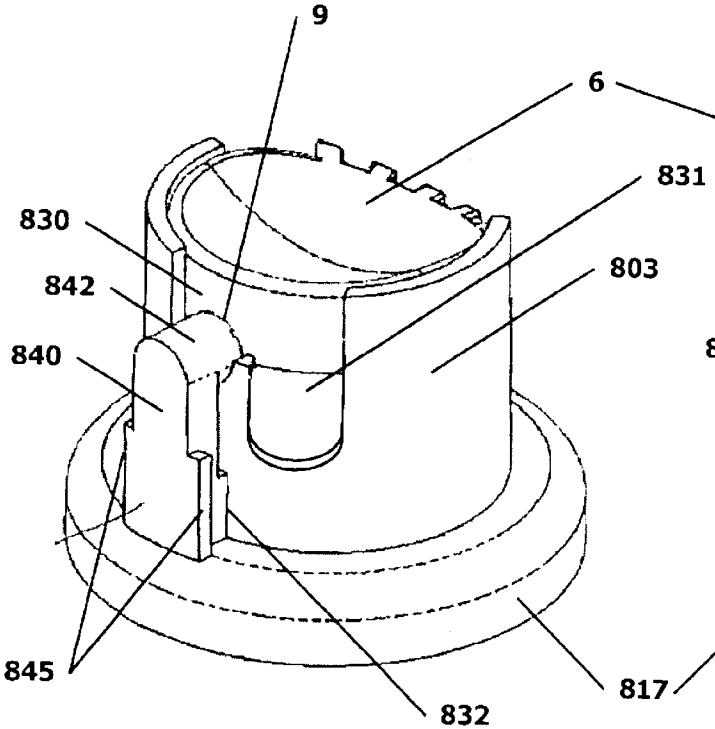
Figure 11:
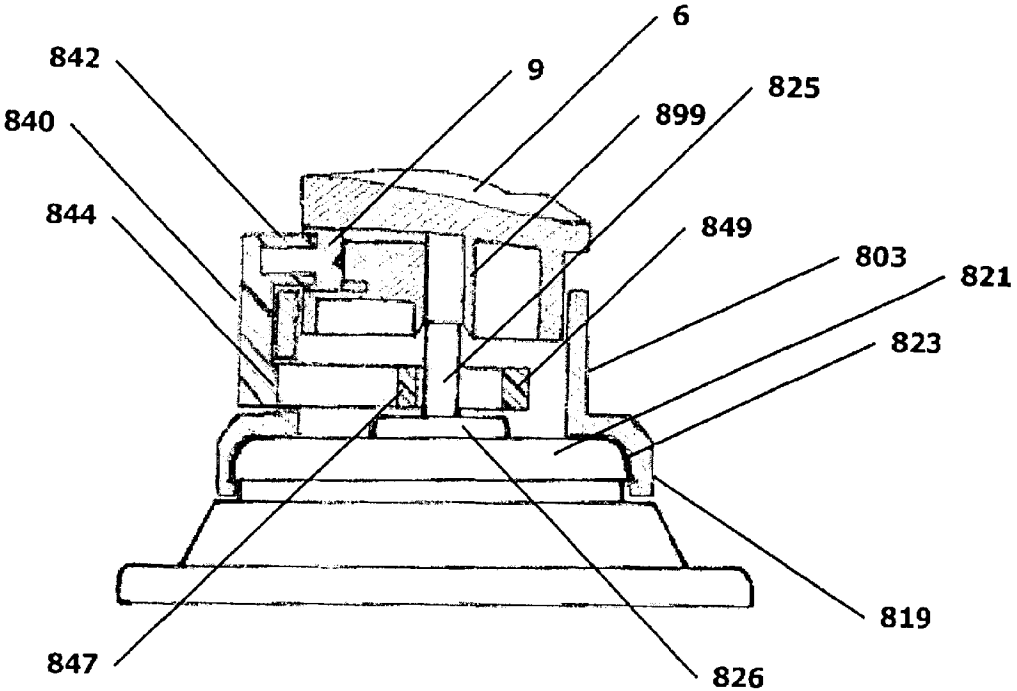
FIG. 11 is a centerline, cross-sectional view of an embodiment of the aerosol dispensing device of the present invention.

FIGS. 8A and 8B depict anterior and posterior perspective views, respectively, of an embodiment of the aerosol dispensing device of the present invention. Actuator 6 may be surrounded, or partially surrounded, by upstanding wall 803, and may include spray nozzle 9 in fluid communication with a downwardly extending projection (e.g., downwardly extending projection 899 of FIG. 11) that engages an upwardly projecting stem (e.g., upwardly projecting stem 825 of FIG. 11) of an aerosol valve (e.g., aerosol valve 826 of FIG. 11); these elements are not shown in FIG. 8A or 8B for clarity. Upstanding wall 803 may include upper opening 830, lower opening 832 and spray opening 831.

Figure 9:
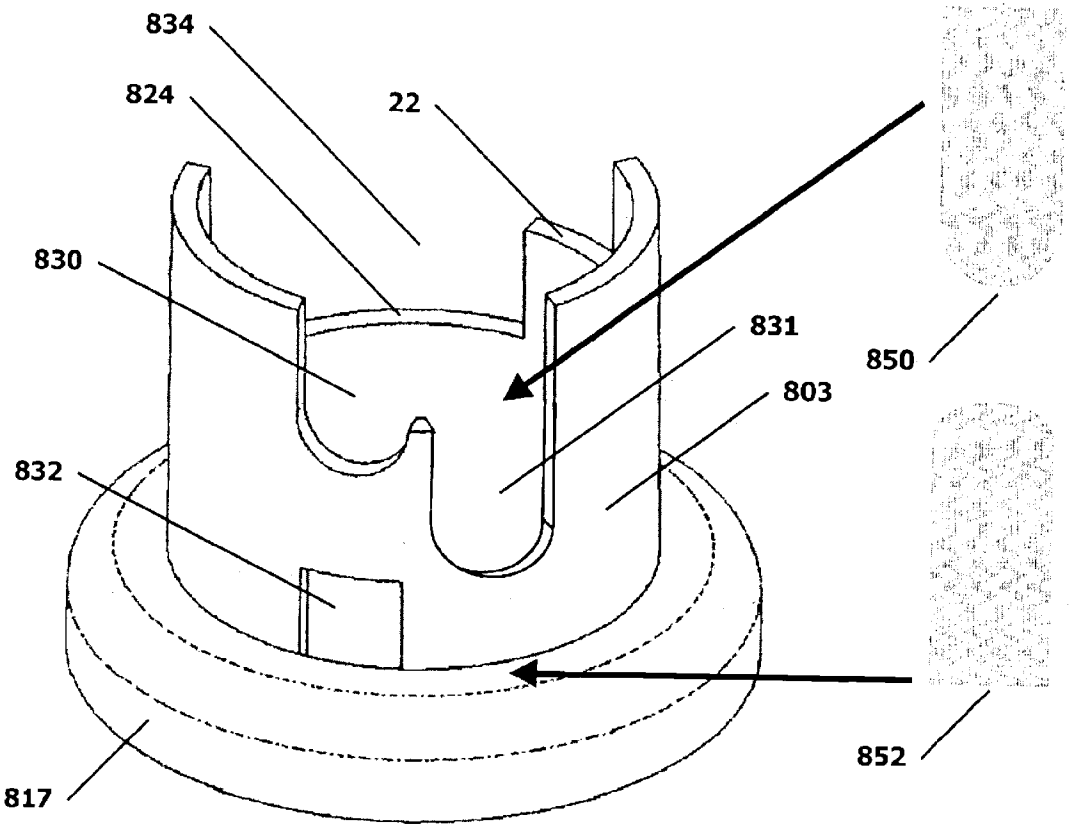
FIG. 9 is a perspective view of an embodiment of the upstanding wall of the present invention.
Figure 10:
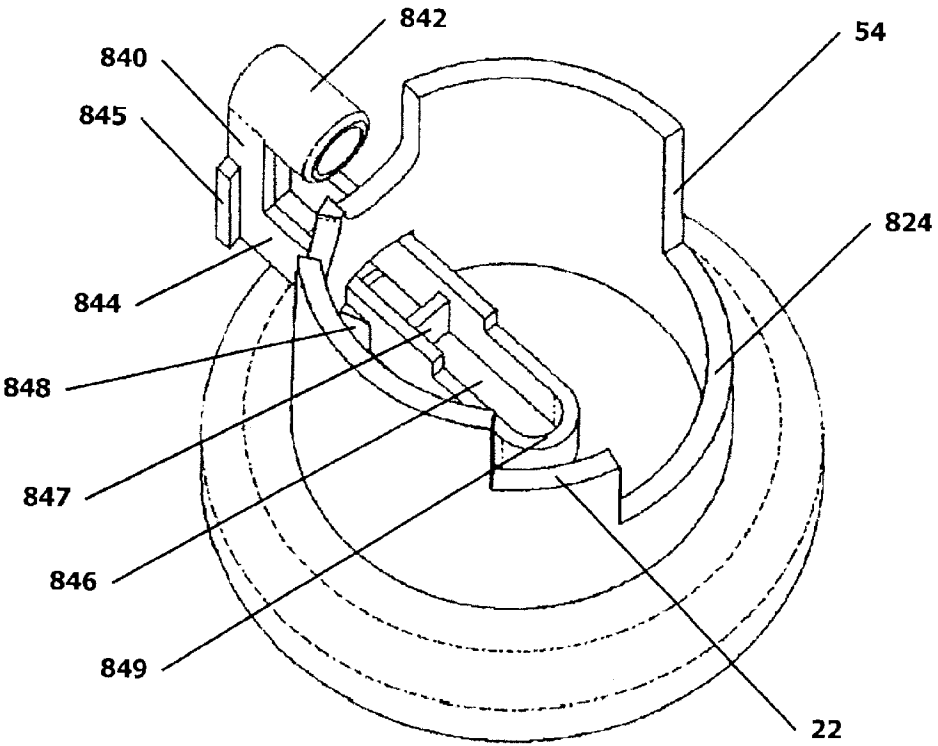
FIG. 10 is a perspective view of an embodiment of the upstanding wall and the nozzle closure of the present invention.

In one embodiment, upper opening 830 and spray opening 831 may form one contiguous opening, as depicted in FIGS. 8A, 9 and 10, while in another embodiment, upper opening 830 and spray opening 831 may form independent, non-contiguous openings. Similarly, in one embodiment, upper opening 830 and lower opening may form independent, non-contiguous openings, as depicted in FIGS. 8A, 9 and 10, while in another embodiment, upper opening 830 and spray opening 831 may form one contiguous opening.

Nozzle closure 840 may include an upper projection 842, fitting into upper opening 830 and spray nozzle 9, to seal spray nozzle 9 when actuator 6 is in a non-dispensing position. Nozzle closure 840 may also include a lower member 844, fitting into lower opening 832, which may facilitate the radial movement of nozzle closure 840 and provide general stability and support, as shown generally in FIGS. 10 and 11. Lower member 844 may include a cutout section 846 to receive upwardly projecting stem 825 of aerosol valve 826, as well as to permit sliding movement of lower member 844 within upstanding wall 803 and along aerosol valve stem 825.

Generally, nozzle closure 840 may be in a closed position when upper projection 842 engages spray nozzle 9 through upper opening 830 (e.g., FIGS. 8A and 8B). Conversely, nozzle closure 840 may be in an open position when upper projection 842 is disengaged from spray nozzle 9 (e.g., FIG. 10), and removed from upper opening 830. In an embodiment, nozzle closure 840 may include extraction flange 845 to provide a gripping surface to facilitate extraction of upper projection 842 from spray nozzle 9 and upper opening 830.

Advantageously, the insertion of upper projection 842, through upper opening 803, into spray nozzle 9 may create a local high pressure region (i.e., greater than atmospheric pressure) which may force excess material from the orifice of spray nozzle 9. Similarly, removal of upper projection 842 from spray nozzle 9 may create a local low pressure region (i.e., lower than atmospheric pressure) which may also facilitate removal of excess material from the orifice of spray nozzle 9. For example, dispensing spray paint from an aerosol container typically involves the accumulation of spray paint residue in, and around, the spray nozzle. The insertion of nozzle projection 842, through upper opening 830, into spray nozzle 9 may create a local pressure region which forces excess paint away from spray nozzle 9. Moreover, the presence of nozzle projection 842 within spray nozzle 9 may also prevent seepage, clotting, etc.

In an embodiment, cross-piece 847 may limit the insertion distance of nozzle closure 840 into upstanding wall 803 by engaging upstanding valve stem 825 when nozzle closure 840 is in the closed position. In another embodiment, lower member 844 may include extraction projection 848 to limit the extraction distance of nozzle closure 840 from upstanding wall 803 by engaging the inner surface of upstanding wall 803. Of course, posterior section 849 of cutout 846 may also engage the aerosol valve stem to limit the extraction distance of nozzle closure 840 from upstanding wall 803. In a further embodiment, posterior section 849 may be open-ended, thereby permitting nozzle closure 840 to be removed entirely from upstanding wall 803, or, alternatively, extraction projection 848 may limit the extraction distance of nozzle closure 840 from upstanding wall 803. In this alternative, nozzle closure 840 may be removed from upstanding wall 803 by compressing lower member 844 to permit extraction projection 848 to clear upstanding wall 803.

Actuator 6 may also include projecting edge 21, such as, for example, a knurled edge, a series of projecting ridges, an overhanging lip, etc., to provide a gripping surface to rotate actuator 6 from a non-dispensing position to a dispensing position. Upstanding wall 803 may include a corresponding opening 834 to facilitate movement of actuator 6 within upstanding wall 803, similar to the embodiments depicted within FIGS. 2–5. Accordingly, in the non-dispensing position, limit stop 22 may engage projecting edge 21 to prevent actuator 6 from moving downward. Similarly, in the dispensing position, projecting edge 21 may travel through opening 834 during the depression of actuator 6, until limit stop 824 engages projecting edge 21 to prevent further downward motion of actuator 6. As noted above, rotating actuator 6 in the direction indicated by arrow S of FIG. 3 places actuator 6 in the dispensing position, while rotating actuator 6 in the direction indicated by arrow L of FIG. 2 places actuator 6 in the non-dispensing position.

When actuator 6 is in the non-dispensing position, nozzle closure 840 is first moved from the closed position, in which upper projection 842 seals spray nozzle 9, to the open position, in which upper projection 842 is clear of spray nozzle 9 and upper opening 830, thereby permitting the rotation of actuator 6. Generally, spray nozzle 9 is adjacent to upper opening 830 when actuator 6 is in the non-dispensing position, and adjacent to spray opening 831 when actuator 6 is in the dispensing position. In an embodiment, breakaway tab 850 may be provided within spray opening 831 to prevent premature, or unauthorized, dispensing of fluid through spray nozzle 9 when actuator 6 is in the dispensing position. Alternatively, breakaway tab 852 may be attached to mounting cup 817, directly in front of spray opening 830, to provide similar protection. In this manner, unauthorized actuation of the dispensing device, e.g., tampering, may be suggested, or detected, by the removal of the breakaway tab. In another embodiment, actuator 6 may include safety tab 50, as generally described above with reference to FIGS. 5, 6 and 7. For example, FIG. 8B shows projecting lip 52, of safety tab 50, abutting vertical wall 54 of upstanding wall 803.

Similar to the embodiment depicted in FIG. 7, mounting cap 817 may include cylindrical skirt 819 which engages beaded rim 823 of mounting cup 821, located at the top of an aerosol container, with a press fit, thereby attaching mounting cap 817, including upstanding wall 803 to the aerosol container. Upstanding wall 803 may be constructed in a manner similar to wall 503, or sleeve 3, of the previously explained embodiments. Mounting cap 817 may be alternatively designed with a bead on its end, which will allow it to snap over a beaded rim of the aerosol container. The aerosol container may include, at its upper end, a beaded rim extending around its entire circumference. In conventional fashion, this is part of the mounting cup.

Operation of actuator 6 from a non-dispensing position to a dispensing position may be described as follows. Nozzle closure 840 may be moved from the closed position to the open position by gripping extraction flange 845 and pulling in an outwardly radial direction. The radial movement may be constrained, for example, by extraction projection 848, by posterior section 849, by a combination of both elements, etc. Once upper projection 842 is clear of upstanding wall 803, actuator 6 may be rotated from the non-dispensing position to the dispensing position by gripping projecting edge 21 and rotating in the appropriate direction. In an embodiment, tab 50 is depressed at the same time as actuator 6 is rotated, so that projecting lip 52 may clear vertical wall 54 of upstanding wall 803. Once projecting edge 21 clears limit stop 22 of upstanding wall 803, actuator 6 is in the dispensing position and actuator 6 may be depressed as often as desired. As noted above, simultaneous rotation of actuator 6 and depression of safety tab 50 may be difficult for small children.

To return actuator 6 to the non-dispensing position, actuator 6 is rotated in the opposite direction, until projecting edge 21 engages limit stop 22. Nozzle closure 840 may then be inserted into spray nozzle 9, the radial movement being constrained, for example, by the interior structure of spray nozzle 9, by the engagement of cross-piece 847 with the stem of the aerosol valve, etc. In an embodiment, once safety tab 50 clears upstanding wall 803, projecting lip 52 engages vertical wall 54 of upstanding wall 803, under the influence of the outward bias of safety tab 50, to prevent rotation of actuator 6.

Of course, it will be recognized by those skilled in the art that a variety of variations may be made in the construction of the above invention without departing from the claims. As such, the scope of the above invention is be limited only by the claims appended hereto.

What is claimed is:

1. An aerosol dispensing device, comprising:

an actuator, including:

a spray nozzle, and a downwardly extending projection, in fluid communication with the spray nozzle, to sealingly engage an upwardly projecting stem of an aerosol valve;

an upstanding wall, at least partially surrounding the actuator, including:

an upper opening adjacent to the spray nozzle when the actuator is in a non-dispensing position, a lower opening below the upper opening, and a spray opening adjacent to the spray nozzle when the actuator is in a dispensing position; and a nozzle closure, including:

an upper projection, fitting into the upper opening and the spray nozzle, to seal the spray nozzle when the actuator is in the non-dispensing position, and a lower member, fitting into the lower opening, in sliding contact with the upstanding wall and the upwardly projecting stem.

2. The device of claim 1, wherein:

the actuator includes a projecting edge; and the upstanding wall includes a posterior opening to permit downward movement of the actuator when the actuator is oriented in a dispensing position.

3. The device of claim 2, wherein the posterior opening includes:

a vertical wall;

a first limit stop to engage the projecting edge of the actuator and prevent downward movement of the actuator when the actuator is oriented in a non-dispensing position; and a second limit stop to engage the projecting edge of the actuator and limit the downward excursion of the actuator when the actuator is oriented in a dispensing position.

4. The device of claim 3, wherein the actuator includes an outwardly biased hinged tab having a projecting lip abutting the vertical wall to prevent rotation of said actuator from the non-dispensing position to the dispensing position, unless the tab is pushed in to clear the vertical wall, while at the same time rotating the actuator from the non-dispensing position to the dispensing position.

5. The device of claim 4, wherein the tab includes a lower part which is part of a wall of the actuator, and an upper part containing the projecting lip forming the portion abutting the vertical wall.

6. The device of claim 5, wherein the tab is integrally molded with the actuator and separated from the actuator by an upper slit and two side slits so as to form a bottom hinge about which said tab may rotate.

7. The device of claim 1, wherein the nozzle closure includes a projecting flange to facilitate extraction of the nozzle closure from the spray nozzle.

8. The device of claim 1, wherein the lower member includes a cutout to receive the upwardly projecting stem of the aerosol valve.

9. The device of claim 8, wherein the lower member includes an extraction projection to abut an inner surface of the upstanding wall and limit an extraction distance of the nozzle closure.

10. The device of claim 9, wherein the lower member includes a cross-piece to abut the upwardly projecting stem of the aerosol valve and limit an insertion distance of the nozzle closure.

11. The device of claim 1, further comprising a breakaway tab, disposed within the spray opening, to cover the spray nozzle when the actuator is in the dispensing position.

12. The device of claim 1, wherein the upstanding wall includes a mounting cap to engage a mounting cup of an aerosol container, the mounting cap having an upstanding breakaway tab, adjacent to the spray opening, to cover the spray nozzle when the actuator is in the dispensing position.

13. An aerosol dispenser, comprising:

an aerosol container;

a mounting cup, attached to the aerosol container, including:

a beaded rim, and an upwardly projecting stem attached to an aerosol valve;

an actuator, including:

a spray nozzle; and a downwardly extending projection, in fluid communication with the spray nozzle, to sealingly engage the upwardly projecting stem;

a mounting cap, including:

a skirt to engage the beaded rim, and an upstanding wall, at least partially surrounding the actuator, including:

an upper opening, and a lower opening below the upper opening; and a nozzle closure, including:

an upper projection, fitting into the upper opening and the spray nozzle, to seal the spray nozzle when the actuator is in the non-dispensing position, and a lower member, fitting into the lower opening, in sliding contact with the upstanding wall and the upwardly projecting stem.

14. The dispenser of claim 13, wherein:

the actuator includes a projecting edge; and the upstanding wall includes a posterior opening to permit downward movement of the actuator when the actuator is oriented in a dispensing position.

15. The dispenser of claim 14, wherein the posterior opening includes:

a vertical wall;

a first limit stop to engage the projecting edge of the actuator and prevent downward movement of the actuator when the actuator is oriented in a non-dispensing position; and a second limit stop to engage the projecting edge of the actuator and limit the downward excursion of the actuator when the actuator is oriented in a dispensing position.

16. The dispenser of claim 15, wherein the actuator includes an outwardly biased hinged tab having a projecting lip abutting the vertical wall to prevent rotation of said actuator from the non-dispensing position to the dispensing position, unless the tab is pushed in to clear the vertical wall while at the same time rotating the actuator from the non-dispensing position to the dispensing position.

17. The dispenser of claim 16, wherein the tab includes a lower part which is part of a wall of the actuator, and an upper part containing the projecting lip forming the portion abutting the vertical wall.

18. The dispenser of claim 17, wherein the tab is integrally molded with the actuator and separated from the actuator by an upper slit and two side slits so as to form a bottom hinge about which said tab may rotate.

19. The dispenser of claim 13, wherein the nozzle closure includes a projecting flange to facilitate extraction of the nozzle closure from the spray nozzle.

20. The dispenser of claim 13, wherein the lower member includes a cutout to receive the upwardly projecting stem.

21. The dispenser of claim 20, wherein the lower member includes an extraction projection to abut an inner surface of the upstanding wall and limit an extraction distance of the nozzle closure.

22. The dispenser of claim 21, wherein the lower member includes a cross-piece to abut the upwardly projecting stem and limit an insertion distance of the nozzle closure.

23. The dispenser of claim 13, further comprising a breakaway tab, disposed within the spray opening, to cover the spray nozzle when the actuator is in the dispensing position.

24. The dispenser of claim 13, further comprising a breakaway tab, attached to the mounting cap and adjacent to the spray opening, to cover the spray nozzle when the actuator is in the dispensing position.

* * * * *